US007583791B2

(12) United States Patent
Hockersmith et al.

(10) Patent No.: US 7,583,791 B2
(45) **Date of Patent: *Sep. 1, 2009**

(54) X-RAY TUBE TARGET ASSEMBLY AND METHOD OF MANUFACTURING SAME

(75) Inventors: Ron Kent Hockersmith, Waukesha, WI (US); Michael Scott Hebert, Muskego, WI (US); Thomas Dean Schaefer, Brookfield, WI (US); Ethan James Westcot, Wauwatosa, WI (US)

(73) Assignee: General Electric Co., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/945,362

(22) Filed: Nov. 27, 2007

(65) Prior Publication Data

US 2008/0069306 A1 Mar. 20, 2008

Related U.S. Application Data

(63) Continuation-in-part of application No. 11/161,778, filed on Aug. 16, 2005, now Pat. No. 7,321,653.

(51) Int. Cl.
*H01J 35/10* (2006.01)

(52) U.S. Cl. ..... 378/144; 378/125; 378/143

(58) Field of Classification Search ..... 378/119, 378/121, 122, 125, 143, 144
See application file for complete search history.

(56) References Cited

U.S. PATENT DOCUMENTS

| | | | | |
|---|---|---|---|---|
| 3,795,832 | A | 3/1974 | Holland | |
| 3,900,751 | A | 8/1975 | Holland et al. | |
| 4,276,493 | A | 6/1981 | Srinivasa et al. | |
| 4,837,793 | A * | 6/1989 | Frankel et al. | 378/34 |
| 6,002,745 | A | 12/1999 | Miller et al. | |
| 6,198,805 | B1 | 3/2001 | Jambunathan et al. | |
| 6,925,152 | B2 | 8/2005 | Steinlage et al. | |
| 6,947,524 | B2 | 9/2005 | Steinlage et al. | |
| 7,321,653 | B2 * | 1/2008 | Hockersmith et al. | 378/144 |

* cited by examiner

*Primary Examiner*—Jurie Yun

(57) ABSTRACT

An X-ray tube target assembly and method of manufacturing same is provided. The X-ray tube target assembly comprises an injection molded target disk. The injection molded target disk includes an injection molded hub member and an injection molded outer member. The injection molded outer member comprises a plurality of injection molded outer member segments that are removably attached together and removably attached to the hub member to form the injection molded target disk. A target track is formed on an outer surface on one side of an outer periphery of the injection molded outer member.

25 Claims, 4 Drawing Sheets

X-RAY TUBE TARGET ASSEMBLY AND METHOD OF MANUFACTURING SAME

CROSS-REFERENCE TO RELATED APPLICATIONS

This application is a continuation-in-part of and claims priority to U.S. patent application Ser. No. 11/161,778, filed on Aug. 16, 2005, the disclosure of which is incorporated herein by reference.

BACKGROUND OF THE INVENTION

This disclosure relates generally to an X-ray tube, and more particularly to an injection molded segmented target assembly for an X-ray tube that is designed for high-speed operation.

Modern medical imaging systems have increased in complexity and imaging capabilities. As computed tomography (CT) imaging systems increase gantry speed in order to image organs and other structures with increasing detail, X-ray tube requirements must increase as well. At these higher gantry speeds, parameters like peak power and anode target rotational speed must be optimized in order to meet the high demands of next generation X-ray tubes. An X-ray tube generally includes a cathode assembly and an anode assembly disposed within a vacuum vessel. The anode assembly includes an X-ray tube target assembly. The X-ray tube target assembly typically consists of a rectangular cross-section target disk that is machined at its periphery to include an angled surface creating an impact zone for an electron beam from the cathode assembly for X-ray generation. The target disk is commonly a rotating disk. With higher peak power requirements, higher rotational speeds and thermal loads on the target disk, the simple rectangular cross-section is no longer sufficient. The increased rotational speeds of the target disk may result in high stresses to the hub portion of the target disk that exceeds present design criteria. The hub portion is the center portion of the target disk that is coupled to a drive shaft. As target disk geometries become more complex, the typical manufacturing and machining processes, such as pressing, sintering and forging used today results in a highly inefficient process. The manufacturing and machining operations are more numerous and more complicated with the cost of parts increasing significantly.

The cathode assembly is positioned at some distance from the anode assembly creating a vacuum gap between the cathode assembly and the anode assembly, and a high voltage potential difference is maintained therebetween. The cathode assembly emits electrons in the form of an electron beam that are accelerated across the potential difference and impact the target disk at a focal spot of the impact zone at a high velocity. As the electrons impact the impact zone of the target disk, the kinetic energy of the electrons is converted to high-energy electromagnetic radiation, or X-rays. The X-rays are then transmitted through a window in the X-ray tube to an object such as the body of a patient and are intercepted by a detector that forms an image of the object's internal anatomy.

In any X-ray tube target assembly design it is likely that the target disk or portions thereof will suffer damage during prolonged usage. This is simply a result of the target disk being impacted by an electron beam to facilitate the generating of X-rays. When the wear or damage becomes too great, existing designs require complete replacement of the target disk. Disassembly and repair is not contemplated by existing designs and may be impractical based on design configurations and associated costs. Since such wear and damage may only occur on certain portions of the target disk, a design where only those portions of the target disk are replaced would be beneficial. In addition, where repair is still not cost effective, a design that allowed reuse of certain portions of the target disk would provide desirable cost benefits.

Therefore, it would be highly desirable to have an X-ray tube target assembly that allows for simplified replacement of worn or damaged portions of the target disk. It would also be highly beneficial to have an X-ray tube target assembly that was manufactured under new manufacturing processes and is capable of withstanding high peak power requirements, high rotational speeds and increased thermal requirements of modern anode assembly performance.

BRIEF DESCRIPTION OF THE INVENTION

In an embodiment, an X-ray tube target assembly comprising an injection molded target disk.

In an embodiment, an X-ray tube target assembly comprising a substantially planar circular-shaped hub member with a central opening extending therethrough for attachment to a drive shaft; a substantially planar circular-shaped outer member removably attachable to an outer perimeter of the hub member; and a target track formed on an outer surface on one side of an outer periphery of the outer member.

In an embodiment, an X-ray tube target assembly comprising a substantially planar circular-shaped hub member with a central opening for attachment to a drive shaft; a plurality of substantially planar pie-shaped outer member segments removably attached together and removably attached to an outer perimeter of the hub member; and a target track formed on an outer surface on one side of an outer periphery of each of the plurality of outer member segments.

In an embodiment, an X-ray tube target assembly comprising an injection molded hub member with a central opening extending therethrough for attachment to a drive shaft; a plurality of injection molded outer member segments removably attachable together and removably attachable to an outer perimeter of the hub member; and a target track formed on an outer surface on one side of an outer periphery of the outer member.

In an embodiment, a method of constructing an X-ray tube target assembly comprising injection molding a substantially planar circular-shaped hub member with a central opening attachable to a drive shaft; injection molding a substantially planar circular-shaped outer member; removably attaching the injection molded outer member to the injection molded hub member; and forming a target track on an outer surface of one side of an outer periphery of the injection molded outer member.

Various other features, aspects, and advantages will be made apparent to those skilled in the art from the accompanying drawings and detailed description thereof.

DETAILED DESCRIPTION OF THE INVENTION

Figure 1:
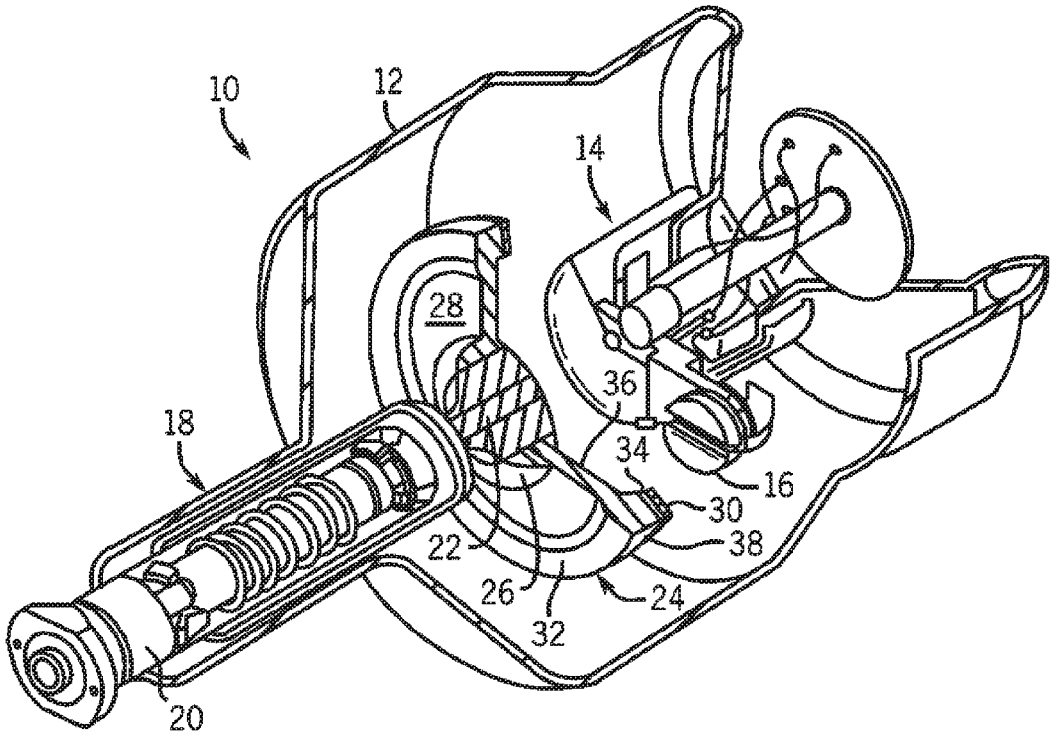
FIG. 1 is a cut away perspective view of an exemplary embodiment of an X-ray tube assembly.

Referring now to the drawings, FIG. 1 illustrates an exemplary embodiment of an X-ray tube assembly 10. The X-ray tube assembly 10 includes a tube casing 12 enclosing a cathode assembly 14 and an anode assembly 18. The tube casing 12 provides a vacuum housing for the anode assembly 18 and the cathode assembly 14. The anode assembly 18 includes a drive assembly 20 rotating a drive shaft 22 that rotates an X-ray tube target assembly 24. The X-ray tube target assembly 24 includes a target disk 28 that is attached to the drive shaft 22 and driven by the drive assembly 20 to rotate the target disk 28 at high speeds. In an exemplary embodiment, the X-ray tube target assembly 24 may include a plurality of injection molded parts that are removably attached together.

The target disk 28 includes a hub member 26 attached to the drive shaft 22, an outer member 32 attached to the hub member 26, and a target track 30 formed on an outer surface 34 on one side 36 of the outer periphery 38 of the outer member 32. The target track 30 is designed for receiving a bombardment of electrons from an electron beam generated by the cathode assembly 14 for the generation of X-rays.

In an exemplary embodiment, the outer member 32 may be removably attached to the hub member 26 such that if the target track 30 experiences undesirable levels of wear or damage, the outer member 32 may be replaced while the hub member 26 remains. In an exemplary embodiment, the outer member 32 may comprise a plurality of outer member segments that are removably attached together and attached to the hub member 26, as will be further discussed with reference to FIGS. 3 and 4 below. In addition to replacement, the present design allows to cost savings through reuse of non-damaged portions of the X-ray tube target assembly 24 in new assemblies. The material used to manufacture the target disk 28 is very expensive. This design allows the reuse of portions of the target disk 28 to provide beneficial cost savings. In addition, the hub member 26 may be optimized to withstand the stresses transmitted to it by the drive assembly 20, while the outer member 32 may be optimized to withstand the thermal energy associated with electron bombardment.

The cathode assembly 14 is positioned at some distance from the anode assembly 18 in the vacuum housing, creating a vacuum gap therebetween, and having a high voltage potential difference maintained therebetween. The cathode assembly 14 generates and emits electrons in the form of an electron beam from a cathode 16. The electrons in the electron beam are accelerated from the cathode 16 across the high voltage potential difference towards the target disk 28 of the anode assembly 18 to impact the target track 30 at a focal spot at high velocity. As the electrons impact the target track 30 of the target disk 28, the kinetic energy of the electrons is converted to high-energy electromagnetic radiation or X-rays. The X-rays are then transmitted through a window (not shown) in the X-ray tube casing 12 to an object such as the body of a patient and are intercepted by a detector that forms an image of the object's internal anatomy. The impact of electrons on the target track 30 generates considerable heat and considerable wear on the target disk 28.

Figure 2:
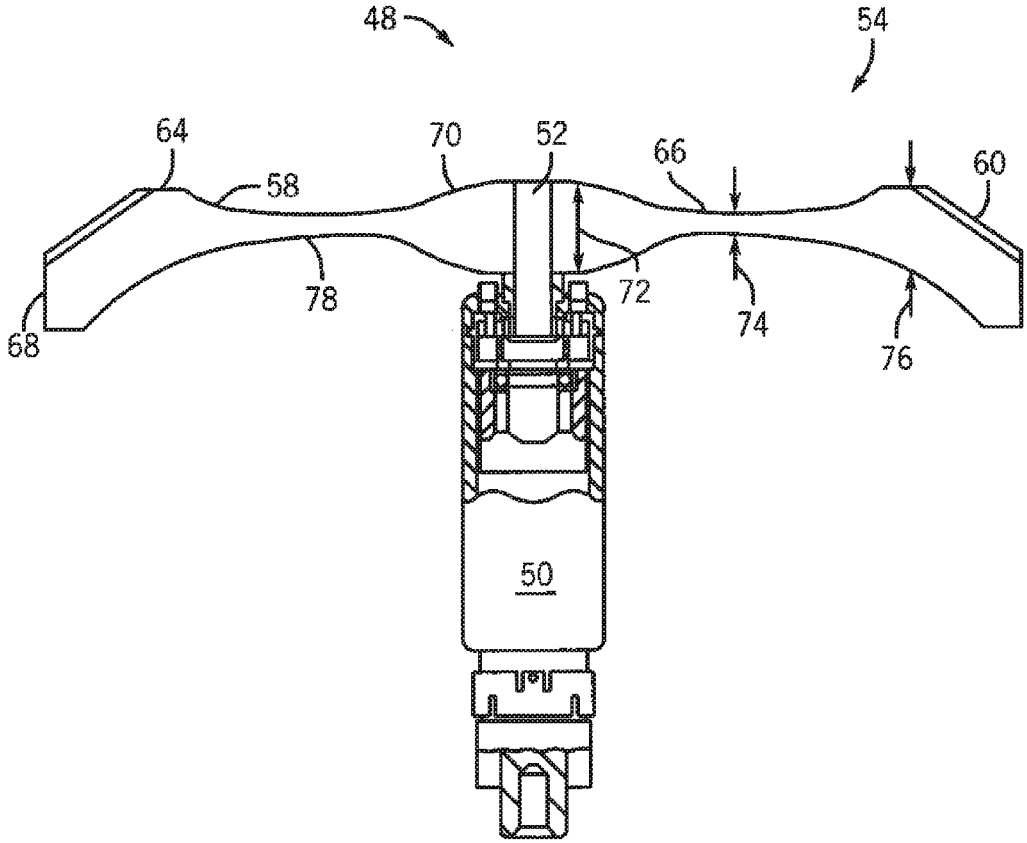
FIG. 2 is a partial cross-sectional view of an exemplary embodiment of an X-ray tube anode assembly.

FIG. 2 illustrates an exemplary embodiment of an X-ray tube anode assembly 48. The anode assembly 48 includes a drive assembly 50 rotating a drive shaft 52 that rotates an X-ray tube target assembly 54. The X-ray tube target assembly 54 includes a target disk 58 that is attached to the drive shaft 52 and driven by the drive assembly 50 to rotate the target disk 58 at high speeds.

In an exemplary embodiment, the target disk 58 may be an integral injection molded part that includes curved outer surfaces with an angled outer surface 64 on one side 66 of an outer portion 68 creating an area for a target track 60 to be applied or formed thereon. The target track 60 formed on the outer surface 64 on one side 66 of the outer portion 68 is designed for receiving a bombardment of electrons from an electron beam generated by a cathode assembly for the generation of X-rays. The target disk 58 is capable of withstanding high rotational speeds and increased thermal requirements of modern X-ray tube anode assembly performance.

In an exemplary embodiment, the target disk 58 includes a hub portion 70 with a cross-sectional width 72 to reduced stresses due to loading transferred from the drive shaft 52, an inner portion 78 with a cross-sectional width 74 that is smaller that the cross-sectional width 72 of the hub portion 70, and an outer portion 68 with a cross-sectional width 76 that is larger that the cross-sectional width 74 of the inner portion 78. The inner portion 78 cross-sectional width 74 is smaller than the outer portion 68 cross-sectional width 78 to prevent thermal transfer from the target track 60 to the hub portion 70.

Figure 3:
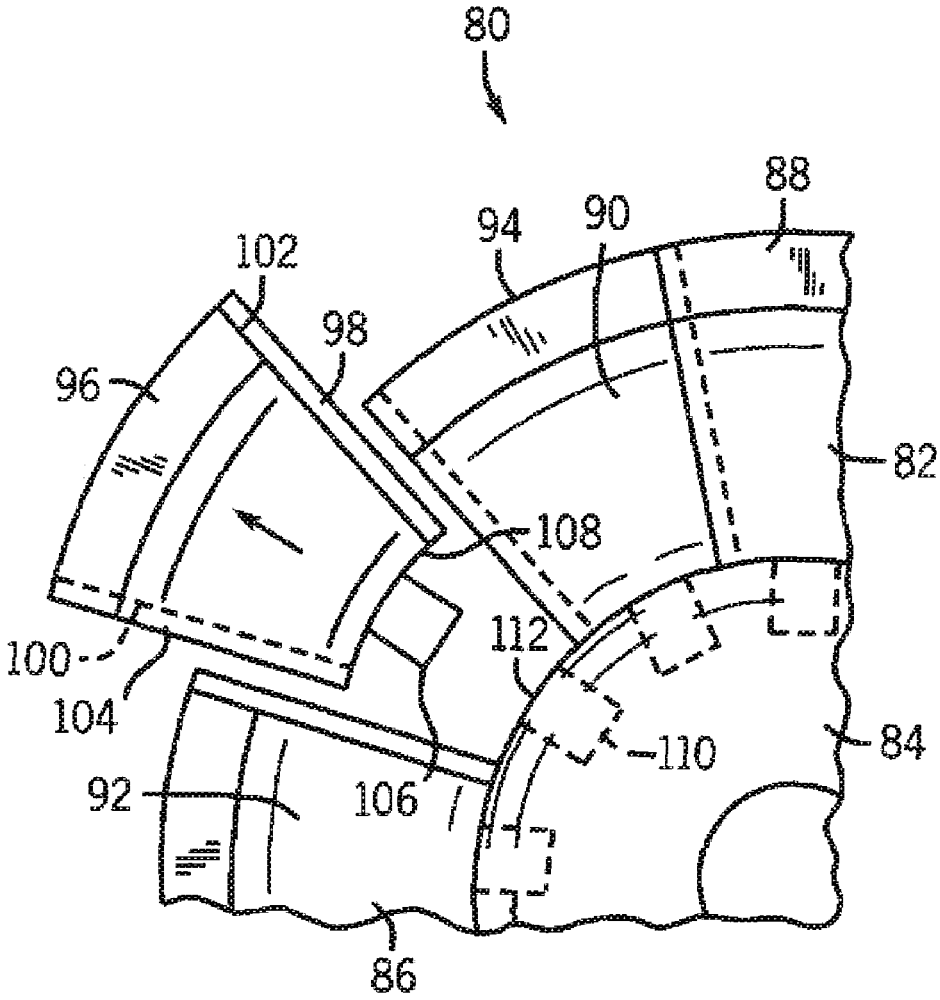
FIG. 3 is a top plan view of a portion of an exemplary embodiment of an X-ray tube target assembly.

FIG. 3 is a top plan view of a portion of an exemplary embodiment of an X-ray tube target assembly 80. The X-ray tube target assembly 80 includes a target disk 82. The target disk 82 includes an injection molded hub member 84 and an injection molded outer member 86. The injection molded outer member 86 is horizontally in-line with and extends radially outwardly from an outer perimeter 112 of the injection molded hub member 84. The injection molded outer member 86 includes a target track 88 formed on an outer surface 90 on one side 92 of an outer periphery 94 of the outer member 86 for receiving a bombardment of electrons from an electron beam generated by a cathode assembly for the generation of X-rays. In an exemplary embodiment, the target track 88 may be a toroidal-shaped target track. While it is contemplated that the outer member 86 may be formed as a single integral injection molded part, the advantages of simplified manufacturing, assembly, and repair are further increased if the outer member 86 is comprised of a plurality of injection molded outer member segments 96 that are removably attached together and removably attached to the injection molded hub member 84.

In an exemplary embodiment, the injection molded hub member 84 may be a substantially planar circular-shaped hub member with a central opening extending therethrough for attachment to a drive shaft. In an exemplary embodiment, the injection molded outer member 86 may be a substantially planar circular-shaped outer member removably attachable to an outer perimeter of the hub member 84.

In an exemplary embodiment, the outer member 86 may comprise a plurality of injection molded pie-shaped outer member segments 96 that are removably attached together and removably attached to an outer perimeter 112 of the injection molded hub member 84. If the target track 88 experiences undesirable levels of wear or damage, the outer member segments 96 may be replaced while the hub member 84 remains. This allows for simplified replacement of worn or damaged portions of the target disk 82. In an exemplary embodiment, the X-ray tube target assembly 80 comprises a target disk 82 including an injection molded hub member 84 and a plurality of injection molded outer member segments 96 removably attached together and removably attached to the injection molded hub member 84. FIG. 3 illustrates an outer member segment 96 being separated from the hub member 84.

It is contemplated that the target disk 82 may be formed in a variety of configurations such that the plurality of outer member segments 96 are removably attached together and removably attached to the hub member 84.

In an exemplary embodiment, each outer member segment 96 may include at least one side tab 98 formed on and extending from a first radial side 102 of the outer member segment 96, and at least one corresponding side slot 100 formed within a second radial side 104 of the outer member segment 96 for accepting at least one mating side tab 98. The first radial side 102 being opposite the second radial side 104. In an exemplary embodiment, each outer member segment 96 may also include at least one end tab 106 extending axially outwardly from an inner perimeter 108 of each outer member segment 96, and a plurality of corresponding end slots 110, one for each end tab 106, formed within an outer perimeter 112 of the hub member 84 for accepting at mating end tab 106. As illustrated in FIG. 3, each side tab 98 of an outer member segment 96 fits within and engages a side slot 100 of a neighboring outer member segment 96, and each end tab 106 of an outer member segment 96 fits within and engages an end slot 110 of the hub member 84 to secure the outer member segments 96 together and secure the plurality of outer member segments 96 to the hub member 84 to form a solid target disk 82.

Other structures and methods of removably interlocking the plurality of outer member segments 96 to the hub member 84 are contemplated within the present disclosure.

Figure 4:
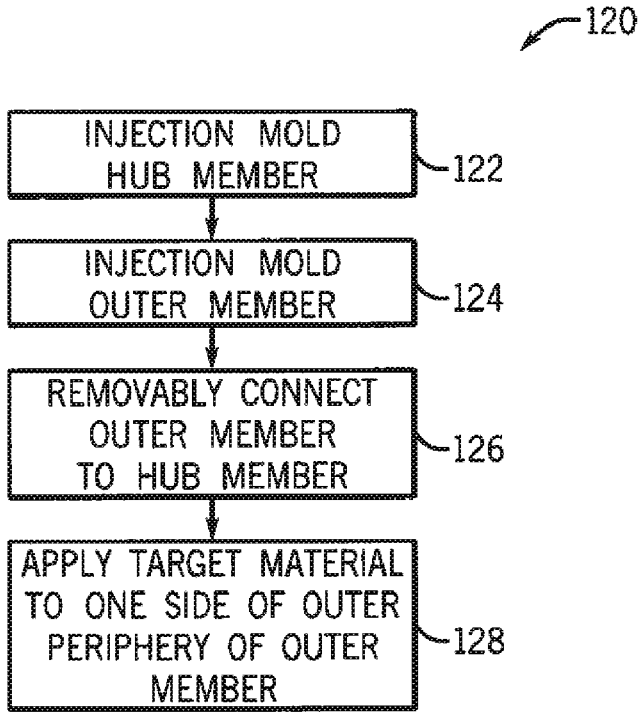
FIG. 4 is flow diagram of an exemplary embodiment of a method of constructing an X-ray tube target assembly.

FIG. 4 is flow diagram of an exemplary embodiment of a method of constructing an X-ray tube target assembly. The X-ray tube target assembly includes a target disk. In order to achieve higher power levels, a geometrically optimized and faster spinning target disk may be required. This disclosure alleviates the problems described above by using a more cost effective and manufacturable method for making a higher power, faster spinning target disk.

The method comprises injection molding a hub member at step 122 and injection molding an outer member at step 124. Injection molding is used in a variety of industries as a cost effective method of producing parts having complex geometries. In an exemplary embodiment, the injection molding process may include a metal injection molding process, which combines the versatility of plastic injection molding with the strength and integrity of machined, pressed or otherwise manufactured small complex metal parts.

In a metal injection molding process, metal powders are blended and mixed with polymer binders and additives, which allow the metal to be injected into a mold. The polymer serves as a binder that allows the metal powders to be injection molded. This blend is then processed on a conventional injection molding machine to form molded parts. The binder is removed from the molded parts in a continuous process under a highly defined and controlled temperature and time profile. During this debinding process, the polymer binder breaks down and dissipates while the metal particles retain all of their molded features. The resultant metal part is then sintered. During sintering, the metal particles fuse together to form a solid metal part. The advantage of metal injection molded parts is such that the complexity and small size of a part or perhaps the difficulty of fabrication through other means may make it cost inefficient or even impossible to manufacture small complex parts using other methods.

The target disk is generally fabricated from a refractory metal with a high atomic number such as molybdenum, tungsten or a tungsten alloy. In an exemplary embodiment, spherical molybdenum powders with an average size of 1-20 μm may be injection molded into complex geometries and sintered in a hydrogen atmosphere at times and temperatures within the range of conventional sintering furnaces. Metal injection molding has been shown to reach a physical and economical limitation as part size increases. Since current X-ray technology calls for target disks in excess of 200 mm in diameter, the capability to injection mold a target disk in a single molding cycle does not conventionally exist. In order to facilitate the injection molding of such a large component, a segmented target disk design is proposed. In an exemplary embodiment, the outer member may include a plurality of outer member segments. In this case, each of the plurality of outer member segments are made from an injection molding process. With this combination of techniques, complex geometries can be produced in a cost effective manner, with a minimum of final machining. The plurality of outer member segments are removably attached together at their sides and removably attached to the hub member at an inner perimeter to form an interlocking target disk.

At step 126, the injection molded outer member is removably attached to the injection molded hub member. In an exemplary embodiment, the outer member may include a plurality of outer member segments. In this case, each of the plurality of outer member segments are removably attached together and removably attached to the hub member.

At step 128, a target track of target material is applied or formed on an outer surface of one side of an outer periphery of the outer member. In an exemplary embodiment, the outer member may include a plurality of outer member segments. In this case, a target track of target material is applied or formed on an outer surface of one side of an outer periphery of each of the plurality of outer member segments. Therefore, the injection molded outer member includes a target track formed on an outer surface on one side of an outer periphery of the outer member for receiving a bombardment of electrons from an electron beam generated by a cathode assembly for the generation of X-rays.

The method described above allows more complex target disk geometries to be easily manufactured at lower machining and scrap cost. These more complex target disk geometries enable higher peak power, faster gantry speeds, and higher target disk spin speeds through geometric optimization. Segmented target disks also have the effect of eliminating hoop stresses.

Figure 5:
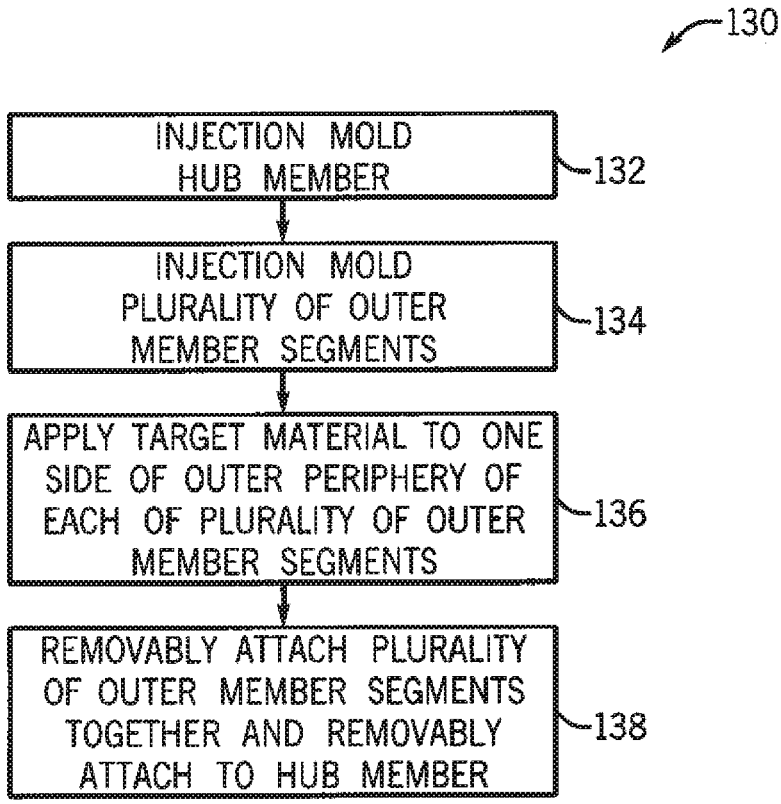
FIG. 5 is flow diagram of an exemplary embodiment of a method of constructing an X-ray tube target assembly.

FIG. 5 is flow diagram of an exemplary embodiment of a method of constructing an X-ray tube target assembly 130. The X-ray tube target assembly includes a target disk. The method comprises injection molding a hub member at step 132 and injection molding a plurality of outer member segments at step 134. Each of the plurality of outer member segments is made from an injection molding process. At step 136, a target track of target material is applied or formed on an outer surface of one side of an outer periphery of each of the plurality of outer member segments. Therefore, each of the plurality of injection molded outer member segments includes a target track formed on an outer surface on one side of an outer periphery thereof for receiving a bombardment of electrons from an electron beam generated by a cathode assembly for the generation of X-rays. At step 138, the plurality of injection molded outer member segments are removably attached together and removably attached to the injection molded hub member. The plurality of outer member segments are removably attached together at their sides and removably attached to the hub member at an inner perimeter to form an interlocking target disk.

Several embodiments are described above with reference to drawings. These drawings illustrate certain details of exemplary embodiments that implement the systems and methods of this disclosure. However, the drawings should not be construed as imposing any limitations associated with features shown in the drawings.

The foregoing description of exemplary embodiments is presented for purposes of illustration and explanation of the disclosure. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated.

While this disclosure has been described with reference to various exemplary embodiments, those skilled in the art will appreciate that certain substitutions, alterations and omissions may be made to the embodiments without departing from the spirit of the disclosure. Accordingly, the foregoing description is meant to be exemplary only, and should not limit the scope of the following claims.

What is claimed is:

1. An X-ray tube target assembly comprising an injection molded target disk, wherein the injection molded target disk is fabricated from a refractory metal with a high atomic number.

2. The X-ray tube target assembly of claim 1, wherein the injection molded target disk includes an injection molded hub member and an injection molded outer member.

3. The X-ray tube target assembly of claim 2, further comprising a target track formed on an outer surface on one side of an outer periphery of the injection molded outer member.

4. The X-ray tube target assembly of claim 3, wherein the target track is a toroidal-shaped target track.

5. The X-ray tube target assembly of claim 2, wherein the injection molded outer member comprises a plurality of injection molded outer member segments that are removably attached together and removably attached to the hub member to form the injection molded target disk.

6. The X-ray tube target assembly of claim 5, further comprising a target track formed on an outer surface on one side of an outer periphery of each injection molded outer member segment.

7. The X-ray tube target assembly of claim 1, wherein the injection molded target disk includes a hub portion, an inner portion and an outer portion.

8. The X-ray tube target assembly of claim 7, wherein the hub portion includes a hub portion cross-sectional width, the inner portion includes an inner portion cross-sectional width, and the outer portion includes an outer portion cross-sectional width.

9. The X-ray tube target assembly of claim 8, wherein the hub portion cross-sectional width is greater than the inner portion cross-sectional width, and the outer portion cross-sectional width is greater than the inner portion cross-sectional width.

10. An X-ray tube target assembly comprising:

a substantially planar circular-shaped hub member with a central opening extending therethrough for attachment to a drive shaft;

a substantially planar circular-shaped outer member removably attachable to an outer perimeter of the hub member; and a target track formed on an outer surface on one side of an outer periphery of the outer member.

11. The X-ray tube target assembly of claim 10, wherein the outer member is horizontally in-line with and extends radially outwardly from the outer perimeter of the hub member.

12. The X-ray tube target assembly of claim 10, wherein the outer member comprises a plurality of pie-shaped outer member segments.

13. The X-ray tube target assembly of claim 12, wherein each outer member segment includes at least one side tab formed on a first radial side of the outer member segment; and at least one side slot formed in a second radial side of the outer member segment; wherein the at least one side tab fits into the at least one side slot on an adjacent outer member segment to removably attach the plurality of outer member segments together to form a complete outer member.

14. The X-ray tube target assembly of claim 13, wherein each outer member segment further includes at least one end tab formed on an inner perimeter of the outer member segment.

15. The X-ray tube target assembly of claim 14, wherein the hub member includes a plurality of end slots formed in an outer perimeter of the hub member, and wherein the at least one end tab of the outer member segment is removably insertable into one of the plurality of end slots of the hub member to removably attach the plurality of outer member segments to the hub member.

16. An X-ray tube target assembly comprising:

a substantially planar circular-shaped hub member with a central opening for attachment to a drive shaft;

a plurality of substantially planar pie-shaped outer member segments removably attached together and removably attached to an outer perimeter of the hub member; and a target track formed on an outer surface on one side of an outer periphery of each of the plurality of outer member segments.

17. The X-ray tube target assembly of claim 16, wherein each of the plurality of outer member segments includes at least one side tab formed on a first radial side of the outer member segment; and at least one side slot formed in a second radial side of the outer member segment; wherein the at least one side tab fits into the at least one side slot on an adjacent outer member segment to removably attach the plurality of outer member segments together to form a complete outer member.

18. The X-ray tube target assembly of claim 17, wherein each of the plurality of outer member segments further includes at least one end tab formed on an inner perimeter of the outer member segment.

19. The X-ray tube target assembly of claim 18, wherein the hub member includes a plurality of end slots formed in an outer perimeter of the hub member, and wherein the at least one end tab of the outer member segment is removably insertable into one of the plurality of end slots of the hub member to removably attach the plurality of outer member segments to the hub member.

20. An X-ray tube target assembly comprising:

an injection molded hub member with a central opening extending therethrough for attachment to a drive shaft;

a plurality of injection molded outer member segments removably attachable together and removably attachable to an outer perimeter of the hub member; and a target track formed on an outer surface on one side of an outer periphery of the plurality of injection molded outer member segments.

21. A method of constructing an X-ray tube target assembly comprising:

injection molding a substantially planar circular-shaped hub member with a central opening attachable to a drive shaft;

injection molding a substantially planar circular-shaped outer member;

removably attaching the injection molded outer member to the injection molded hub member; and forming a target track on an outer surface of one side of an outer periphery of the injection molded outer member;

wherein injection molding includes forming the substantially planar circular-shaped hub member and the substantially planar circular-shaped outer member from a refractory metal with a high atomic number.

22. The method of claim 21, wherein the step of injection molding a substantially planar circular-shaped outer member includes injection molding a plurality of substantially planar pie-shaped outer member segments.

23. The method of claim 22, wherein the step of removably attaching the injection molded outer member to the injection molded hub member includes removably attaching the plurality of substantially planar pie-shaped outer member segments together and removably attaching the plurality of substantially planar pie-shaped outer member segments to the injection molded hub member.

24. The method of claim 23, wherein the step of forming a target track on an outer surface of one side of an outer periphery of the injection molded outer member includes forming a target track on an outer surface of one side of an outer periphery on each of the plurality of substantially planar pie-shaped outer member segments.

25. A method of constructing an X-ray tube target assembly comprising:

injection molding a substantially planar circular-shaped hub member with a central opening attachable to a drive shaft;

injection molding a plurality of substantially planar pie-shaped outer member segments;

forming a target track on an outer surface of one side of an outer periphery on each of the plurality of substantially planar pie-shaped outer member segments; and removably attaching the plurality of substantially planar pie-shaped outer member segments together and removably attaching the plurality of substantially planar pie-shaped outer member segments to the injection molded hub member.

* * * * *